US005639270A

United States Patent [19]

Barbieri et al.

[11] Patent Number: 5,639,270

[45] Date of Patent: Jun. 17, 1997

[54] SELF-LOCKING MATING TERMINAL STRUCTURE

[75] Inventors: Silvio Barbieri, Padua; Roberto Martucci, Montegrotto T. Padua, both of Italy

[73] Assignee: Molex Incorporated, Lisle, Ill.

[21] Appl. No.: 534,148

[22] Filed: Sep. 26, 1995

[30] Foreign Application Priority Data

Nov. 17, 1994 [EP] European Pat. Off. ..... 94118081

[51] Int. Cl.[6] ..... H01R 11/22

[52] U.S. Cl. ..... 439/849; 439/852

[58] Field of Search ..... 439/842–852, 439/856, 861, 862

[56] References Cited

U.S. PATENT DOCUMENTS

| | | | |
|---|---|---|---|
| 3,065,451 | 11/1962 | Rutter | 439/849 |
| 4,550,963 | 11/1985 | Moors | 339/31 R |
| 4,579,409 | 4/1986 | Enneper et al. | 339/74 R |
| 4,632,483 | 12/1986 | Verin | 339/74 R |
| 4,696,530 | 9/1987 | Vandame | 439/266 |
| 4,699,444 | 10/1987 | Isohata | 439/839 |
| 5,135,414 | 8/1992 | van Dijk | 439/692 |

FOREIGN PATENT DOCUMENTS

| | | | |
|---|---|---|---|
| 1540606 | 9/1968 | France | 439/849 |
| 1130879 | 6/1962 | Germany | 439/849 |
| 3242635 | 11/1982 | Germany . | |
| 3704886 | 2/1987 | Germany . | |

*Primary Examiner*—David L. Pirlot
*Attorney, Agent, or Firm*—Stacey E. Caldwell

[57] ABSTRACT

A mating terminal structure includes a generally box-shaped female terminal defining a receptacle with a flexible cantilevered contact beam formed from a bottom wall thereof. The beam includes a radiused contact portion. A male terminal is insertable into the receptacle in a given insertion direction (A) and includes a contact cam for deflecting the cantilevered contact beam and engaging the contact portion thereof. The contact cam has a leading ramp surface extending at a relatively small acute angle relative to the insertion direction for engaging the contact portion and gradually deflecting the cantilevered contact beam. The contact cam also has a trailing locking surface extending at a relatively larger acute angle relative to the insertion direction for providing locking interference between the contact portion of the cantilevered beam and the contact cam of the male terminal to thereby removably lock the male terminal to the female terminal.

6 Claims, 5 Drawing Sheets

SELF-LOCKING MATING TERMINAL STRUCTURE

FIELD OF THE INVENTION

This invention generally relates to the art of electrical connectors and, particularly, to an electrical connector assembly in which a pair of connectors are locked together by interengagement of the mating terminals of the connectors.

BACKGROUND OF THE INVENTION

In general, an electrical connector assembly conventionally includes a pair of electrical connectors such as plug and receptacle or other male and female connectors that mate together in a particular configuration. Each connector conventionally includes an insulating or dielectric housing within which are mounted one or more electrical terminals. The terminals may be hard wired to electrical wires or cables, or one or both of the connectors may be mounted to a printed circuit board with the terminals coupled to circuit traces on the board. In any event, the terminals of the two mating connectors also mate or interconnect in a particular configuration. For instance, a female or receptacle terminal may be adapted for receiving a male or pin terminal.

In connector assemblies of the character described above, a positive connection between the mating connectors typically is ensured by one or more of the following systems: (a) positive locking between the connector housings; (b) positive locking between the terminals; or (c) frictional retention between the housings and/or the terminals. Each of these systems heretofore has created various problems.

In particular, when the locking function is performed by positive locking between the connector housings, such as integrally molded or separate metallic latches, the housings often involve complicated molds or costly secondary components and assembly, and consequently create a larger envelope size for the overall connector assembly in order to accommodate these locking mechanisms. This is highly undesirable particularly in contemporary proposals for greater miniaturization of electrical connector assemblies. In the case of secondary metallic latches, the costs of the separate dies and secondary assembly procedures can drastically increase the costs associated with the connectors. Furthermore, the latches may be inadvertently unlocked, broken or removed from the housing and the connectors inadvertently uncoupled.

When positive locking occurs between the terminals themselves, excessive mating forces often make unmating of the connectors difficult, if not impossible. This is particularly true when one or both of the interlocked terminals must be "actuated" in order to release the locking mechanism. In other words, locking mechanisms such as depressible cams or wedges must be manually released in order to disconnect the terminals. Furthermore, latching between the terminals can often lead to damage to one or both of the terminals when the connectors are subjected to repeated mating cycles. The locking capability of the releaseable latches eventually degrades as the number of cycles increase.

Frictional retention of the terminals and/or the connector housings often is adversely affected in environments wherein the connectors are subjected to vibrations or thermal expansion which can lead to uncontrolled and undesired unmating of the connectors. Furthermore, a strictly frictional connection does not provide a sensory feedback to a user as to the complete mating of the connectors, thereby increasing the risk of open circuits and incomplete or partial mating in such applications.

The present invention is directed to solving the myriad of problems outlined above by providing a positive connection between mating connectors by employing a removably latchable mating terminal structure that does not compromise the locking capability of the structure over a large number of mating cycles, yet still provides a sensory or tactile feedback upon complete mating of the component male and female terminals.

SUMMARY OF THE INVENTION

An object, therefore, of the invention is to provide a new and improved mating terminal structure for removably latching together a pair of electrical connecting devices or connectors.

In the exemplary embodiment of the invention, the terminal structure generally includes a planar male blade terminal. A generally box-shaped female terminal receives the male blade terminal. The female terminal has a flexible cantilevered contact beam with a radiused contact portion adapted to be engaged and deflected by the male blade terminal upon insertion of the blade terminal into the female terminal in a given direction of insertion.

The invention contemplates that the male blade terminal include an integral contact cam for engaging the radiused contact portion of the female terminal upon complete insertion of the blade terminal thereinto. The contact cam has a leading ramp surface extending at a relatively small acute angle relative to the direction of insertion for deflecting the cantilevered contact beams and engaging the contact portion thereof. The contact cam also has a trailing locking surface extending at a relatively larger acute angle relative to the insertion direction for providing locking interference between the contact portion of the cantilevered beam and the contact cam of the male terminal to thereby removably lock the male terminal to the female terminal.

In the preferred embodiment of the invention, the male blade terminal comprises a stamped and formed sheet metal component with the contact cam integrally formed from a planar portion of the terminal.

The cantilevered contact beam of the female terminal is complementarily shaped for receiving and interfacing with the male terminal. In particular, the cantilevered contact beam extends upwardly and rearwardly towards the contact portion of the female terminal from a bottom wall thereof at a relatively small acute angle relative to the direction of insertion of the male terminal for gradual engagement by the leading ramp surface of the contact cam. On the other side of the contact portion, the beam extends at a relatively larger acute angle relative to the insertion direction for locking engagement with the trailing locking surface of the contact cam.

Lastly, the invention includes a connector assembly in which first and second dielectric connector housings respectively mount one or more of the disclosed locking male and female terminal structures.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENT

Figure 1:
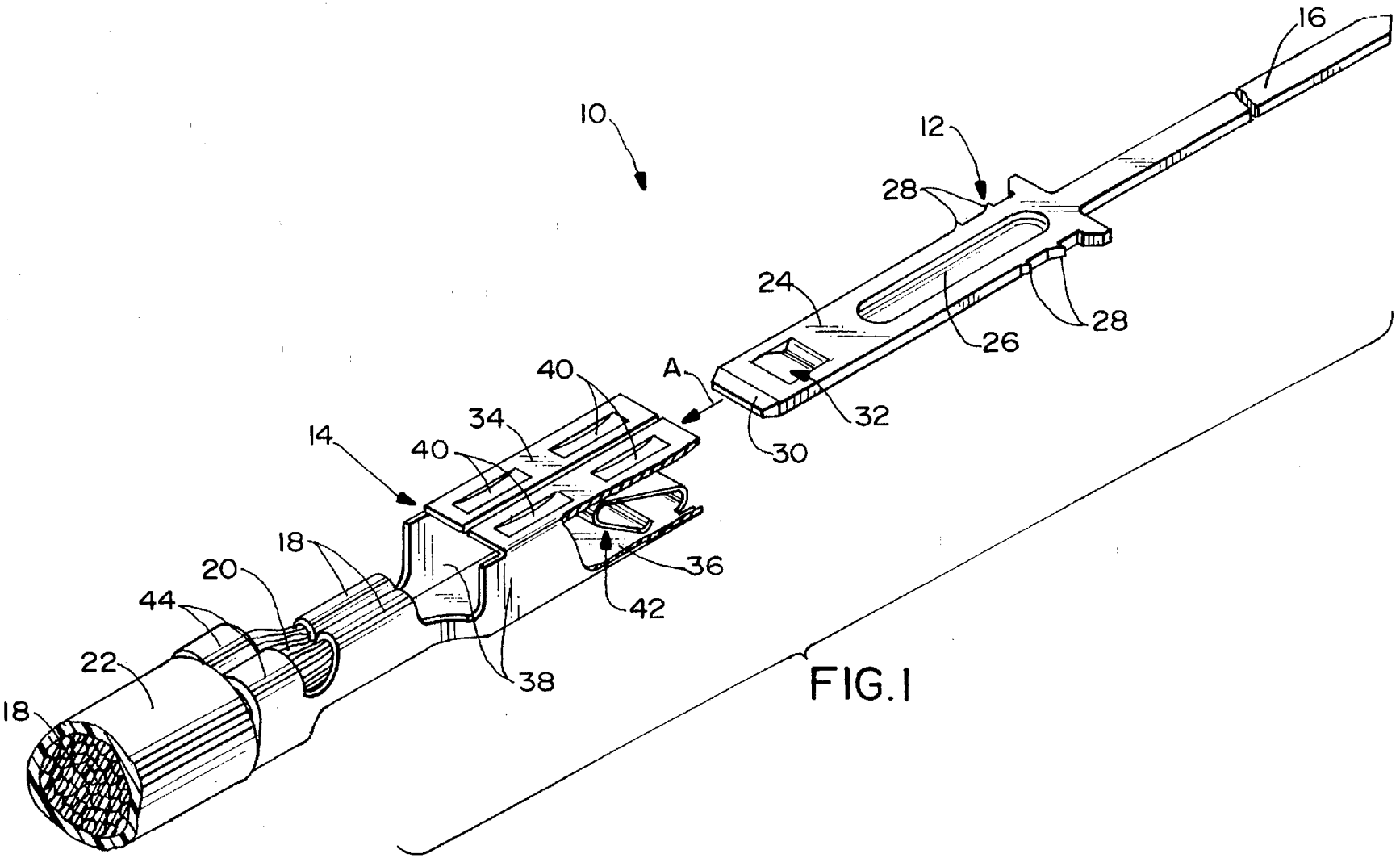
FIG. 1 is a perspective view of the mating terminal structure of the invention, with the male and female terminals disengaged.

Referring to the drawings in greater detail, and first to FIG. 1, the invention is incorporated in a mating terminal structure, generally designated 10, which includes a generally planar male blade terminal, generally designated 12, and a generally box-shaped female terminal, generally designated 14. Male terminal 12 includes a tail portion 16 for coupling to a circuit trace on a printed circuit board, as will be apparent hereinafter. Female terminal 14 includes a pair of crimp arms 18 for crimping or otherwise terminating to the conductors 20 of an electrical cable 22.

More particularly, male blade terminal 12 is stamped and formed of conductive sheet metal material, with tail portion 16 forming a terminating end of the terminal, and a generally planar portion 24 forming the mating or blade end of the terminal. The planar portion of male blade terminal 12 includes a longitudinally extending reinforcing rib 26 and side tangs 28 for skiving into the plastic material of a connector housing to secure the terminal therein. The distal end of blade portion 24 is chamfered or tapered, as at 30, to facilitate insertion of the male terminal into female terminal 14 in a direction of insertion as indicated by arrow "A". Lastly, the male blade terminal incudes a contact cam, generally designated 32, formed out of planar portion 24 at the mating end of the terminal to be discussed in detail hereinafter. It is understood that the crimp arms 18 of female terminal 14 and the terminating end of the male terminal are exemplary only and that the terminals may include any such terminating ends known in the art.

Female terminal 14 is formed of conductive sheet metal material and includes a box-shaped mating end defined by a top wall 34, a bottom wall 36 and a pair of side walls 38 and function to center and guide male blade terminals 12 upon insertion into the female terminal. A flexible cantilevered contact beam, generally designated 42, is formed upwardly and rearwardly from a forward edge of bottom wall 36 within the box-shaped mating end of the terminal and toward the crimp arms 18 for engaging contact cam 32 of male terminal 12, as will be described hereinafter. A second pair of crimp arms 44 are located at the terminating end of female terminal 14 rearward of conductor crimp arms 18 for crimping onto the outer insulation or cladding 46 of electrical cable 22 to provide strain relief means therefor.

Figure 2:
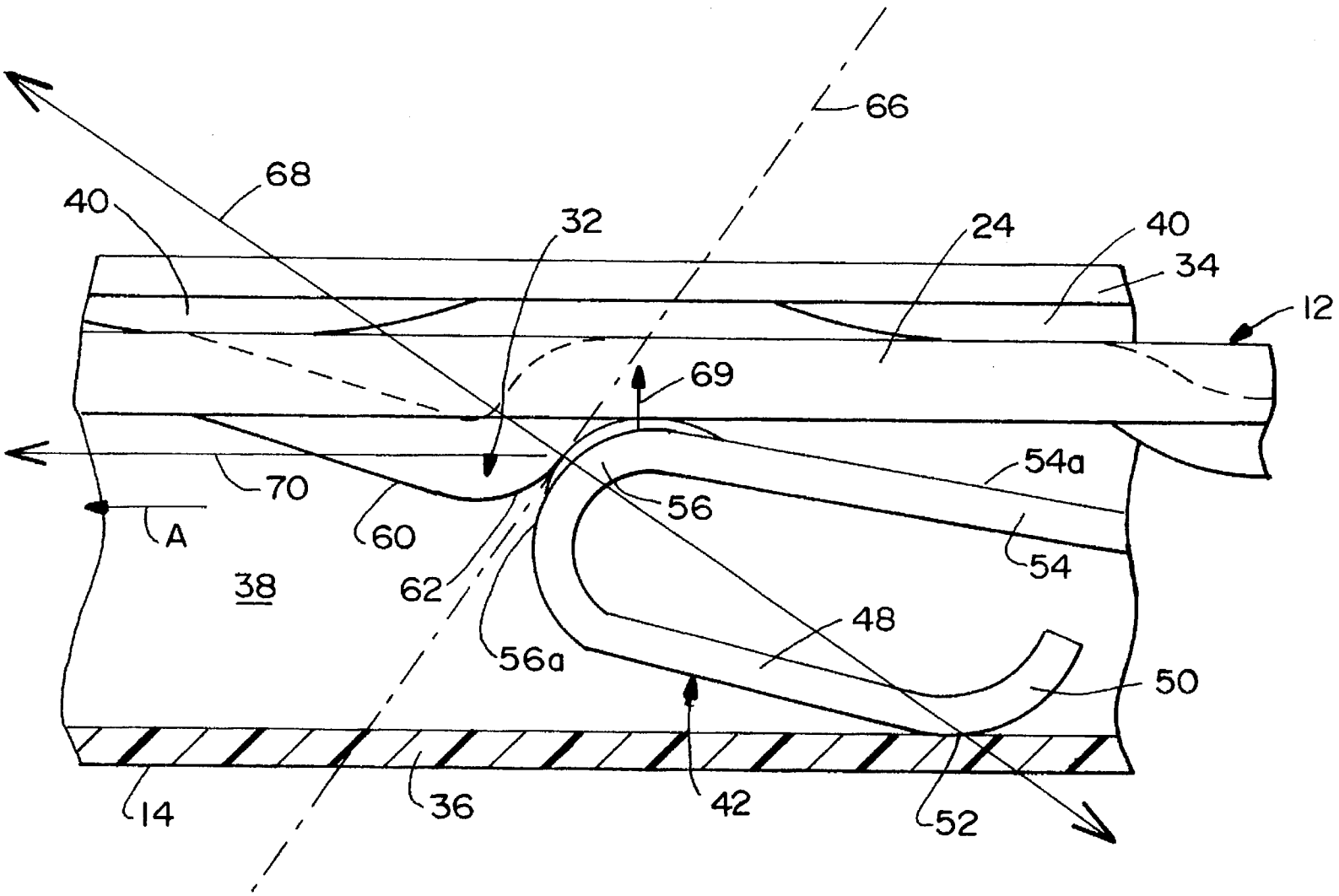
FIG. 2 is a fragmented vertical section through the female terminal, with the male terminal engaged therewith.

Referring to FIG. 2 in conjunction with FIG. 1, flexible cantilevered contact beam 42 of female terminal 14 is generally U-shaped and includes a bottom leg 48 having a free end 50 for engaging the inside of bottom wall 32, as at 52. A top leg 54 is cantilevered upwardly and rearwardly within the box-shaped female terminal from the front edge of bottom wall 36. Bottom and top legs 48 and 54 of the contact beam are joined by a curved or radiused contact portion 56. It can be seen clearly in FIG. 2 that this particular shape of contact beam 42 includes an angled surface **54*a* on top leg 54 which extends at a relatively shallow acute angle relative to the insertion direction of arrow "A" from one side of contact portion 56. On the opposite side of contact portion 56, the shape of the beam includes locking surface 56*a*** which extends at a relatively larger acute angle relative to insertion direction "A".

Still referring to FIG. 2, as stated above, male blade terminal 12 has an integral radiused contact cam, generally designated 32 protruding from planar portion 24. This contact cam is operatively associated with flexible cantilevered contact beam 42. More particularly, contact cam 32 has a leading ramp surface 60 extending at a relatively small acute angle relative to insertion direction "A" for gradually deflecting contact beam 42 and riding over angled surface **54*a* and contact portion 56 as the male blade terminal is inserted into the female terminal. Because of the relatively small acute angle of leading ramp surface 60 and the correspondingly small acute angle of surface 54*a* of the contact beam, relatively low insertion forces are required to insert the male terminal into the female terminal. The contact portion 56*a*** of the contact beam may include an area of higher normal force for improved contact between the terminals in their mated condition.

Contact cam 32 further includes a trailing locking surface 62 which extends at a relatively larger acute angle relative to the direction of insertion "A". The angled locking surface 62 is adapted for providing locking interference between contact portion 56 of cantilevered contact beam 42 and contact cam 32 to thereby removably lock male terminal 12 to female terminal 14.

The functional operation of contact cam 32 and the configuration of cantilevered contact beam 42 can be understood in FIG. 2 by noting that phantom line 66 represents a plane tangent to the mating interface between trailing locking surface 62 of the contact cam and locking surface **56*a* of contact portion 56 of the cantilevered contact beam. Arrow 68 represents an axis normal to tangent plane 66, i.e. the axis of the normal force between the mating terminals in response to a pulling force on male terminal 12 opposite insertion direction "A". Arrow 70 represents the component of normal force 68 extending parallel to insertion direction "A" which represents the locking force between the terminals. This configuration provides a reliable high contact force connection and allows unmating of the terminal structure at a relatively high threshold force but without risk of damage to the terminals because the terminals interengage on two radiuses (i.e. at angles other than zero degrees to axis 66). This radiused configuration actually facilitates mating of the connectors. In other words, the radiused configuration creates a "pull-in effect" due to the spring-back forces of cantilevered contact beam 42. Furthermore, due to the abrupt angles of trailing surface 62 of contact cam 32 and of locking surface 56*a* of contact beam 42**, a sudden reduction of insertion forces is created during insertion of the male terminal, also due to the spring-back of the contact beam, to provide sensory feedback to a user that the terminals are fully mated.

From the foregoing, it can be understood that the reliability of mating terminal structure 10 is assured by the mating profile described above, and the connection is robust against such conditions as vibrations and other inadvertent disconnections. The low mating force of the terminal structure combined with the larger unmating force avoids unintentional disconnections during use yet allows disconnection of the terminals without employing an actuating means such as a depressible cam, wedge or other releasing mechanism.

Figure 3:
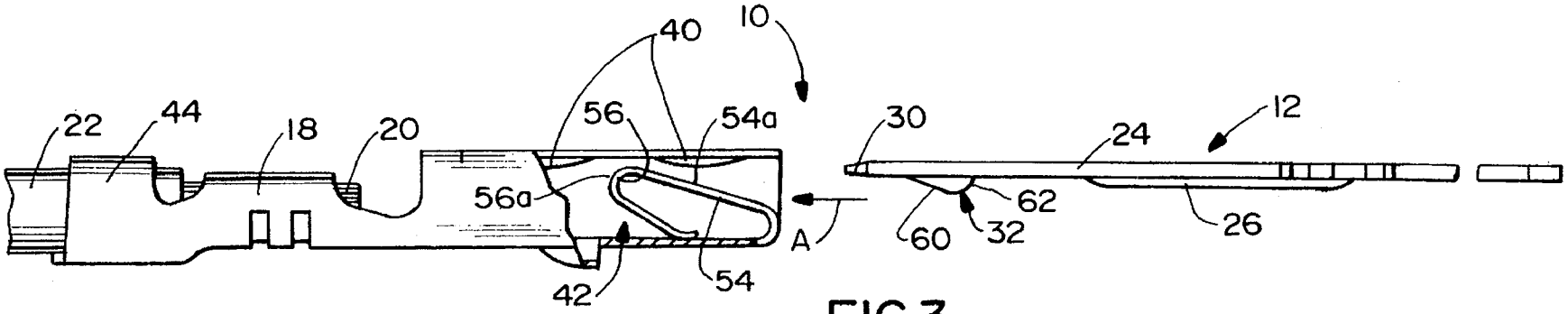
FIG. 3 is a fragmented section through the mating end of the female terminal, with the male terminal about to be inserted thereinto.
Figure 4:
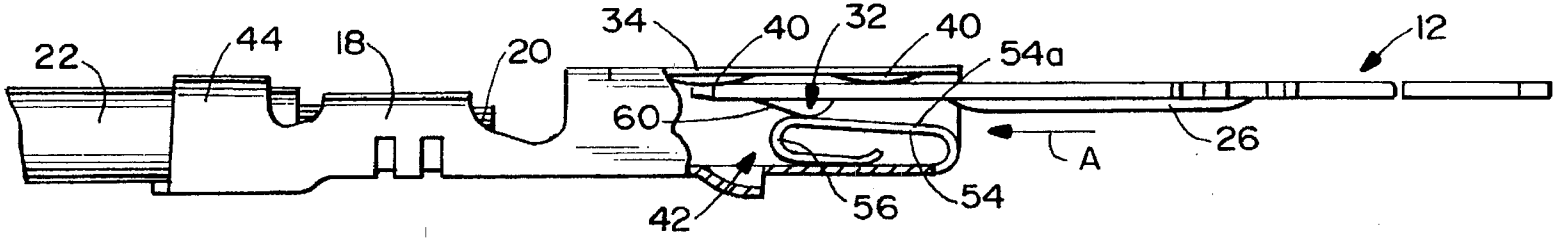
FIG. 4 is a view similar to that of FIG. 3, but with the male terminal partially inserted into the female terminal and deflecting the flexible cantilevered contact beam thereof.
Figure 5:
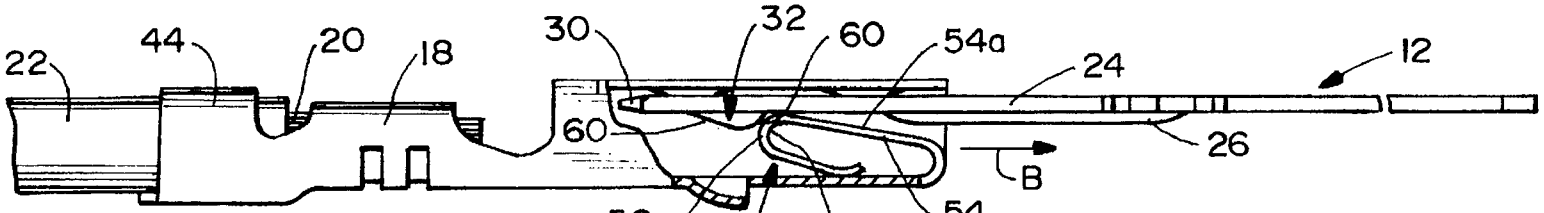
FIG. 5 is a view similar to that of FIG. 4, but with the male terminal fully inserted into the female terminal.

FIGS. 3–5 show the sequence of insertion of male terminal 12 into female terminal 14 of terminal structure 10. Specifically, FIG. 3 shows male terminal 12 prior to insertion into the box-shaped mating end of female terminal 14. It can be seen that flexible cantilevered contact beam 42 of the female terminal is in an unstressed, non-deflected condition.

FIG. 4 shows male terminal 12 partially inserted into female terminal 14, with contact cam 32 of the male terminal deflecting cantilevered contact beam 42. During this action, the contact cam rides over the contact beam, i.e. leading ramp surface 60 of the contact cam gradually deflects and rides over contact surface 54*a* of the contact beam with minimum insertion forces. The blade terminal is centered and guided into the female terminal by detents 40 in top wall 34 thereof.

FIG. 5 shows male terminal 12 fully inserted into female terminal 14. This fully inserted position corresponds to the relative positions of the terminals shown in FIG. 2 and described in detail above. Whereas the male terminal was inserted into the female terminal in the direction of arrow "A" with minimum forces due to the smaller angles of surface leading range surface 60 and contact surface 54*a* of the male and female terminals respectively, in order to withdraw the terminal in the direction of arrow "B" (FIG. 5), significantly greater forces must be applied to overcome the locking forces created by the larger angles of surface 62 on the male terminal and locking surface 56*a* on the female terminal as described above in relation to FIG. 2.

Figure 6:
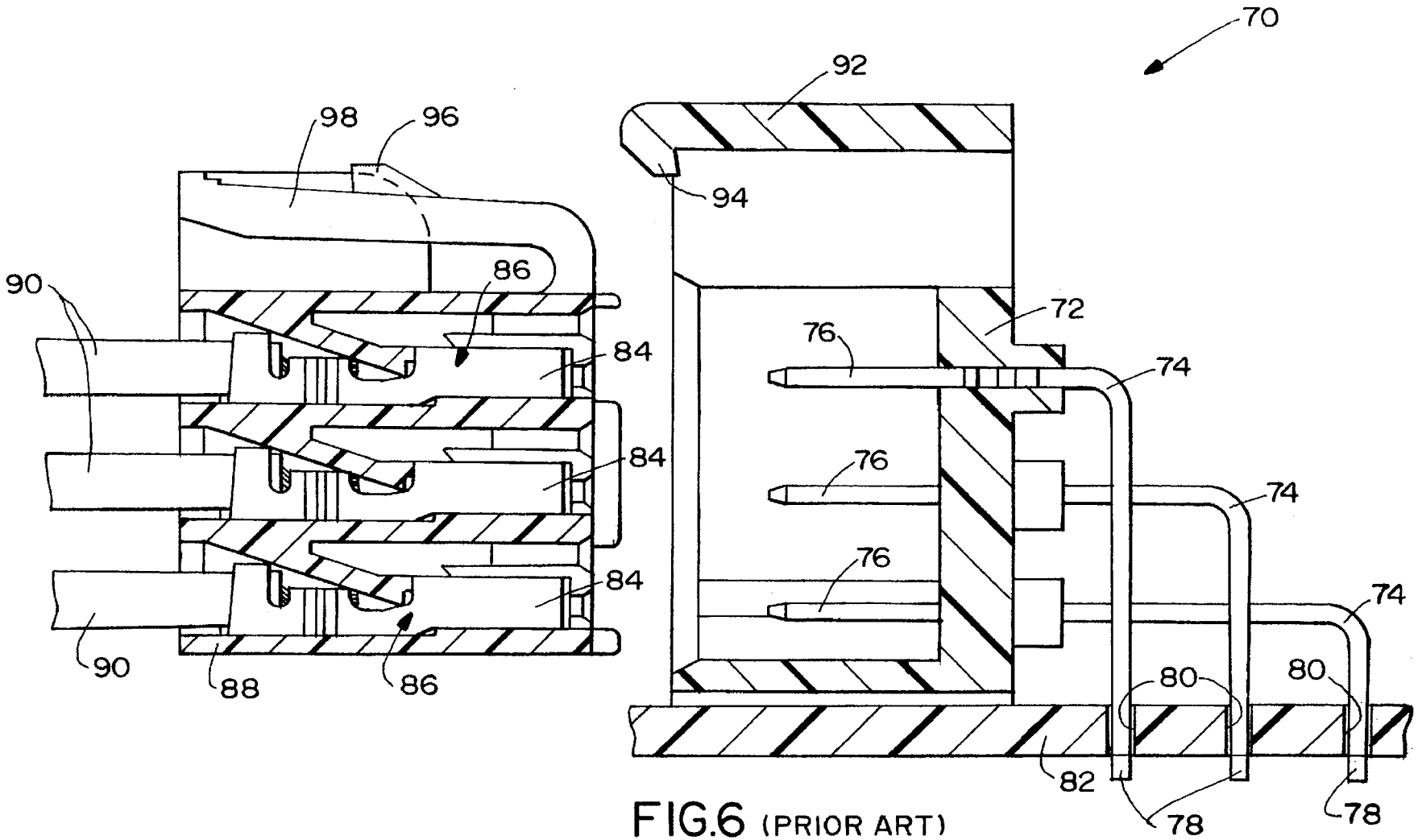
FIG.6 (PRIOR ART)
FIG. 6 is a vertical section through a connector assembly of the prior art which includes a latching structure between the connector housings.

FIG. 6 shows an electrical connector, generally designated 70, typical of connectors found in the prior art. Very generally, the connector assembly includes a first connector 72 mounting a plurality of male terminals 74 which have male terminal pins or blades 76 at mating ends of the terminals and tail portions 78 at terminating ends of the terminals. The tail portions are adapted for insertion into holes 80 in a printed circuit board 82 for coupling to circuit traces on the board and/or in the holes. Terminal pins 76 are adapted for insertion into mating ends 84 of female terminals 86 of a complementary mating second connector 88. The female terminals are connected to discrete electrical cables 90, similar to female terminal 14 described above. First and second connectors 72 and 88, respectively, of connector assembly 70 are positively locked together through the connector housings and by means of a latch arm 92 on connector 72 having a hooked portion 94 for snapping locking engagement with a locking boss 96 on a latch arm 98 of connector 88.

Figure 7:
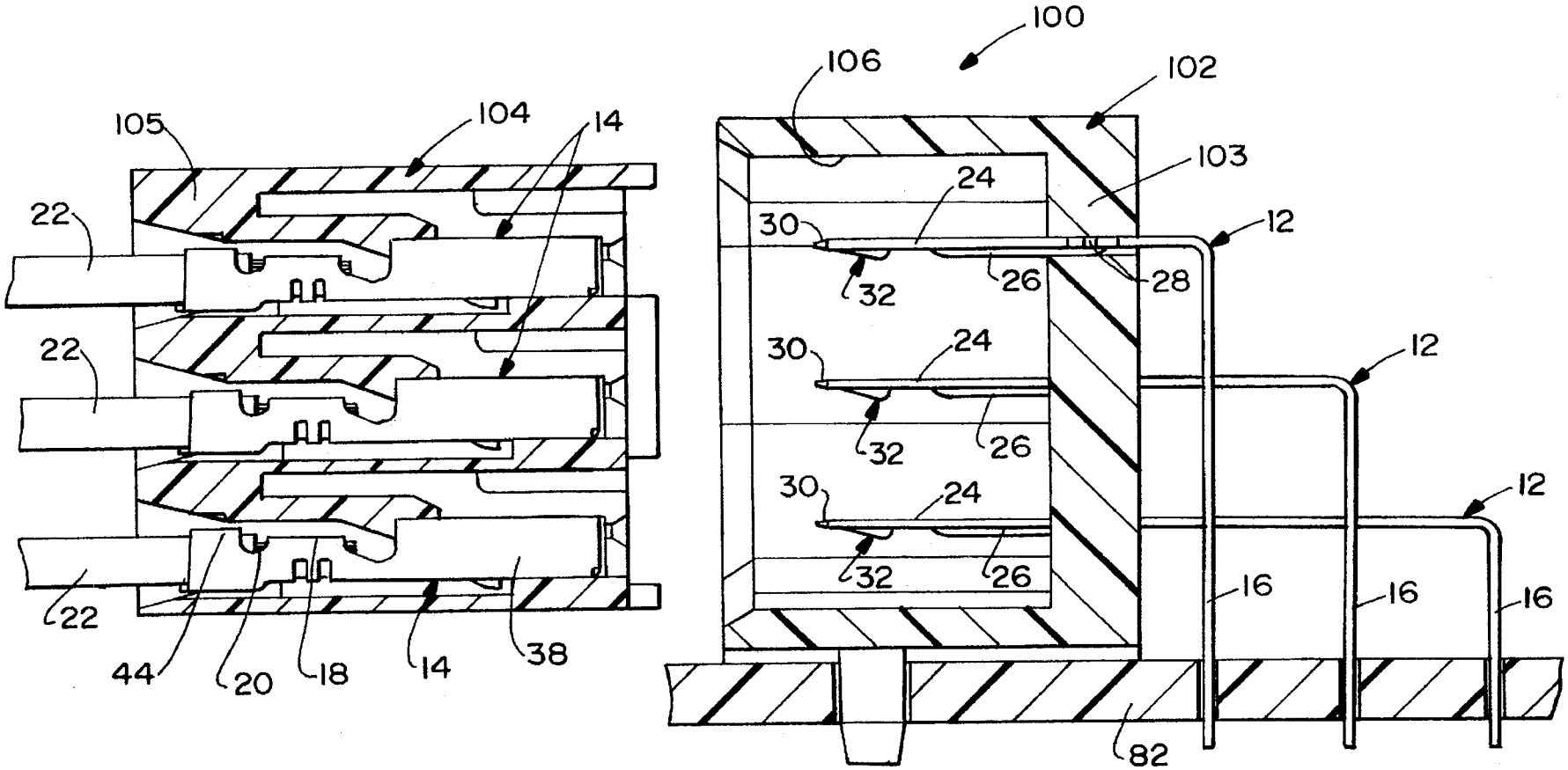
FIG. 7 is a vertical section through a connector assembly incorporating the mating terminal structure of the invention.

FIG. 7 shows a connector assembly, generally designated 100, wherein a receptacle connector 102 includes a dielectric housing 103 which mounts a plurality of the male blade terminals 12 described above in relation to FIGS. 1–4. A plug connector 104 includes a dielectric housing 105 which is adapted for insertion into a cavity 106 of receptacle connector 102. The plug connector mounts a plurality of the female terminals 14 described above in relation to FIGS. 104. According to the invention, connectors 102 and 104 of connector assembly 100 are positively locked by the interengagement between male terminals 12 and female terminals 14, as is shown and described above and in FIGS. 1–5.

Now, by comparing the connector assembly of FIG. 7 to the prior art connector assembly 71 of FIG. 6, it can be seen how the overall envelope size or profile of connector assembly 100 is reduced in comparison to connector assembly 70 which uses a locking system between the connector housings rather than directly between the terminals as is contemplated by the invention.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

We claim:

1. In a mating terminal structure which includes a generally planar male blade terminal, a generally box-shaped female terminal for receiving the male blade terminal and having a flexible cantilevered contact beam with a radiused contact portion adapted to be engaged and deflected by the male blade terminal upon insertion of the blade terminal into the female terminal in a given direction of insertion (A), wherein the improvement comprises:

said male blade terminal having an integral contact cam for engaging the radiused contact portion of the female terminal upon insertion thereinto, the contact cam defined by a radiused projection integrally formed from a planar portion of the terminal and having a leading ramp surface extending from the radiused projection at a relatively small acute angle relative to said insertion direction (A) for gradually deflecting the cantilevered contact beam with minimum insertion forces during insertion of the blade terminal into the female terminal and for engaging the contact portion of the cantilevered contact beam, and a trailing locking surface extending from the radiused projection at a relatively large acute angle relative to said insertion direction (A) for providing a positive interference between the contact portion and the contact cam thereby removably locking the male terminal to the female terminal.

2. In a mating terminal structure as set forth in claim 1, wherein the cantilevered contact beam of the female terminal comprises:

a leg having an angled surface which extends rearwardly from a first side of said contact portion at a relatively shallow acute angle relative to said insertion direction (A) for engagement by the leading ramp surface of the contact cam; and a locking surface which extends from a second side of said contact portion at a relatively larger acute angle relative to the insertion direction for locking engagement with the trailing locking surface of the contact cam.

3. A mating terminal structure, comprising:

a female terminal defining a receptacle with a flexible cantilevered contact beam therein, the beam including a rounded contact portion; and a male terminal insertable into the receptacle of the female terminal in a given insertion direction (A) and including a rounded contact cam adapted to gradually deflect the cantilevered contact beam and engage the contact portion thereof, the contact cam integrally formed from a planar portion of the terminal and having a leading ramp surface extending from the radiused projection at a relatively small acute angle relative to said insertion direction (A) adapted to gradually deflect the cantilevered contact beam with minimum insertion forces, and a trailing locking surface extending from the radiused projection at a relatively larger acute angle relative to said insertion direction adapted to provide a positive interference between the contact portion and the contact cam and thereby removably lock the male terminal to the female terminal.

4. In a mating terminal structure as set forth in claim 3, wherein the receptacle of the terminal is box-shaped and includes a top wall, a bottom wall and a pair of side walls; and wherein the cantilevered contact beam projects upwardly and rearwardly from said bottom wall and includes:

a leg having an angled surface extending from the contact portion at a relatively shallow acute angle relative to said insertion direction (A) for engagement by the leading ramp surface of the contact cam; and a locking surface extending from the contact portion at a relatively larger acute angle relative to the insertion direction (A) for locking engagement with the trailing locking surface of the contact cam.

5. A connector assembly, comprising:

a first electrical connector including a dielectric housing mounting a plurality of female terminals, each female terminal defining a receptacle with a flexible cantilevered contact beam formed from a bottom wall thereof, the beam including a rounded contact portion; and a second electrical connector for mating to the first electrical connector, and including a dielectric housing mounting a plurality of male terminals, each male terminal being insertable into the receptacle of the female terminal in a given insertion direction (A) and including a rounded contact cam for deflecting the cantilevered contact beam of the female terminal and engaging the contact portion thereof, the contact cam defined by a radiused projection integrally formed from a planar portion of the terminal and having a leading ramp surface which extends from the radiused projection at a relatively shallow acute angle relative to said insertion direction (A) for deflecting the cantilevered contact beam with minimum insertion forces during insertion of the male terminal into the receptacle, and a trailing locking surface extending from the radiused projection at a relatively larger acute angle relative to said insertion direction for providing a positive interference between the contact portion and the contact cam;

whereby upon complete insertion of the first connector into the second connector, the male terminals are removably locked to the female terminals.

6. The electrical connector assembly of claim 5, wherein the receptacle of each female terminal is box-shaped and includes:

a top wall, a bottom wall and a pair of side walls;

and the cantilevered contact beam includes:

a leg having an angled surface which extends upwardly and rearwardly from said bottom wall at a relatively shallow acute angle relative to said insertion direction (A) for engagement of the rounded contact portion by the leading ramp surface of the contact cam; and a locking surface which extends downwardly and rearwardly from the rounded contact portion at a relatively larger acute angle relative to the insertion direction (A) for locking engagement with the trailing locking surface of the contact cam.

* * * * *